US007797978B2

(12) United States Patent
Sasso, Jr. et al.

(10) Patent No.: US 7,797,978 B2
(45) Date of Patent: Sep. 21, 2010

(54) METHOD AND APPARATUS FOR MAKING TWO-PIECE BEVERAGE CAN COMPONENTS

(75) Inventors: Joseph A. Sasso, Jr., Rockford, IL (US); Shaun Kelly, Wrexham (GB)

(73) Assignees: Rexam Beverage Can Company, Chicago, IL (US); Rexam Beverage Can Europe Ltd., Luton (GB)

( * ) Notice: Subject to any disclaimer, the term of this patent is extended or adjusted under 35 U.S.C. 154(b) by 126 days.

(21) Appl. No.: 11/607,468

(22) Filed: Nov. 30, 2006

(65) Prior Publication Data

US 2008/0127705 A1 Jun. 5, 2008

(51) Int. Cl.
*B21D 11/10* (2006.01)

(52) U.S. Cl. ..... 72/379.4; 72/405.01; 72/419; 72/715

(58) Field of Classification Search ..... 72/41, 72/46, 336, 348, 349, 361, 379.4, 404, 405.01, 72/419, 420, 714, 42, 347, 43, 424, 715; 413/69, 70, 76; 414/795.4, 797.4, 797.8, 414/801, 816
See application file for complete search history.

(56) References Cited

U.S. PATENT DOCUMENTS

| | | | | |
|---|---|---|---|---|
| 1,492,230 | A | | 4/1924 | Towne |
| 1,702,278 | A | | 2/1929 | Simons |
| 2,080,399 | A | | 5/1937 | Deibel |
| 2,088,223 | A | | 7/1937 | Witte |
| 2,099,449 | A | | 11/1937 | Metzger |
| 2,350,491 | A | | 6/1944 | Butler et al. |
| 2,789,344 | A | | 4/1957 | Kaul |
| 3,029,507 | A | | 4/1962 | Gaggini |
| 3,545,631 | A | * | 12/1970 | Chivas et al. ..... 414/788.4 |
| 3,990,353 | A | * | 11/1976 | Richards et al. ..... 493/108 |
| 4,199,073 | A | * | 4/1980 | Gombas ..... 220/623 |
| 4,213,324 | A | * | 7/1980 | Kelley et al. ..... 72/405.02 |
| 4,342,404 | A | * | 8/1982 | Baker ..... 221/10 |
| 4,454,743 | A | * | 6/1984 | Bulso et al. ..... 72/349 |
| 4,546,873 | A | * | 10/1985 | Debenham et al. ..... 198/836.2 |

(Continued)

FOREIGN PATENT DOCUMENTS

EP 1 136 154 A1 9/2001

(Continued)

OTHER PUBLICATIONS

International Search Report from co-pending PCT Application No. PCT/US2007/086048, mailed Mar. 11, 2008.

*Primary Examiner*—Edward Tolan
(74) *Attorney, Agent, or Firm*—Ungaretti & Harris LLP

(57) ABSTRACT

A method of forming two-piece beverage can components is described. The method requires providing a plurality of pre-punched metallic disks. A disk feeder transfers at least one of the plurality of pre-punched metallic disks to a first process station in a plurality of processing stations. The first disk is deformed during a two-piece beverage can component manufacturing process is performed at the first station. The deformed disk is removed from the first station and transferred to each subsequent processing station in the plurality of processing stations. Further two-piece beverage can component manufacturing processes are performed in each subsequent processing station to produce a substantially finished two-piece beverage can component.

20 Claims, 7 Drawing Sheets

U.S. PATENT DOCUMENTS

| | | | | | |
|---|---|---|---|---|---|
| 4,567,746 | A | * | 2/1986 | Bachmann et al. | 72/348 |
| 4,655,677 | A | * | 4/1987 | Lenhart | 414/802 |
| 5,095,730 | A | * | 3/1992 | Lauder | 72/347 |
| 5,119,657 | A | * | 6/1992 | Saunders | 72/42 |
| 5,301,534 | A | * | 4/1994 | Nishikawa et al. | 72/348 |
| 5,377,518 | A | | 1/1995 | Abbott | |
| 5,572,893 | A | | 11/1996 | Goda et al. | |
| 5,611,454 | A | | 3/1997 | Abbott | |
| 5,626,049 | A | * | 5/1997 | Saunders | 72/347 |
| 6,349,586 | B1 | | 2/2002 | Johnson et al. | |
| 6,463,776 | B1 | * | 10/2002 | Enoki et al. | 72/46 |
| 6,802,197 | B2 | | 10/2004 | Barrera | |
| 6,945,085 | B1 | | 9/2005 | Goda | |
| 7,108,469 | B2 | * | 9/2006 | Jenkins | 413/8 |
| 2005/0138984 | A1 | | 6/2005 | Cook et al. | |

FOREIGN PATENT DOCUMENTS

| | | | |
|---|---|---|---|
| JP | 8-257661 | * | 8/1996 |
| JP | 8-257661 | * | 10/1996 |
| JP | 2000 015371 A | | 1/2001 |
| JP | 2007 045507 A | | 2/2007 |
| WO | 2007020946 A1 | | 6/2008 |

* cited by examiner

METHOD AND APPARATUS FOR MAKING TWO-PIECE BEVERAGE CAN COMPONENTS

TECHNICAL FIELD

The invention relates to a method and apparatus for making two-piece beverage can components. More particularly, the present invention relates to a method and apparatus for continuously making two-piece beverage can components from a plurality of pre-punched metallic disks.

BACKGROUND OF THE INVENTION

Two-piece cans are widely used in the beverage industry to package soft drinks, alcoholic drinks, and the like. These two-piece beverage cans typically include a thin-walled tubular body portion having a closed end and an open end. The open end is sealed by a can end once the can body has been filled with a liquid beverage.

Can bodies are produced from a metal sheet product, typically aluminum or steel. The aluminum or steel sheet arrives at the can manufacturing plant in very large coils. The sheet is fed continuously from an uncoiler or payoff reel into a cupping press which cuts out thousands of disks per minute and forms them into shallow cups. This is called the blank and draw process. Surplus material from the coil is recycled, and sold back to the material supplier.

The shallow cups are transported to a bodymaker where the can body begins to take its final shape. In the bodymaker, the shallow cup goes through a process called draw and iron or DI. During DI, the shallow cup is placed in front of a moving ram which forces it through a series of precision rings, each a little smaller than the previous one. This reduces the thickness of the metal (wall ironing) and, as a result, the can gets taller. At the end of the stroke the base is formed, and the can body is removed from the ram.

A trimmer shears material excess about the open end of the can body. This trimming process insures that the can body is the correct height, and that the rim about the open end is uniform and free of earring (misshapen metal). Again, the surplus material from this process is recycled.

The trimmed can bodies then pass through highly efficient washers to remove lubricants used during the forming process and to prepare the can body outer surface for coating and printing. Cans are then dried in a drier or oven.

Depending on customer and design requirements, the outer surface of the can bodies may be externally coated with a white or clear base coat at a base coater station.

The next step is a highly sophisticated decorator, which applies a design to the outer surface of the can body using up to six colors. All six colors are printed onto the can body in the same operation. A clear-coat over-varnish is sometimes added to the printed can bodies to give a glossy finish.

Next, the inner surface of each can body is sprayed with a coating. This special layer is to protect the product in the can from interaction with the metal of the can body.

The decorated can bodies are then passed through a necker/flanger which reduces the diameter of the open end of the can body. This gives the can bodies the characteristic neck shape. Here, the diameter of the top of the can is reduced or 'necked-in'. The top of the can is flanged outwards to enable the can end to be seamed to the can body after the can bodies are filled with a liquid beverage.

The can bodies are quality tested at each stage of manufacture. At the final stage, the can body is put through a series of additional tests, including a light test and internal and external inspection cameras. Any defective can bodies are automatically rejected.

Finally, the cans are packed on to pallets which are then either sent to a warehouse for storage or transported directly to the beverage producer for filling.

The can ends or lids are produced in a separate process. Can end manufacture begins with a large coil of aluminum or steel. The metal sheet is fed through a shell press, which stamps out and forms the basic can end shell. The can end shell is an unfinished can end with no forming and no tab attached—just a flat disk with the outside diameter curled to accept a can body neck. Scrap metal from the coil is collected and recycled.

The shells are transferred to a balancer or manual rollover station where the orientation of the shell is reversed so that a public side is face down and the product side is face up.

A special type of sealant called compound is applied to the inside curl of the shell. This ensures a perfect curl when the finished can end is seamed on to can body. This process is called lining and is done at very high speed on a compound lining machine.

Again, the shells are transferred to a balancer or manual rollover station where the orientation of the shell is reversed. In this beverage can component process the product side is turned face down, and the public side is turned face up.

The final step in the can end process is converting the lined shell into a finished end. This is done in a conversion press. This process forms and scores the shell into a finished or substantially finished can end or lid, and attaches a tab to the can end. There can be eight or more separate stages, or progressions, involved in converting a shell into a finished end at the conversion press.

Typically, the conversion press also produces a strip of tabs from a narrow coil of aluminum or steel sheet which is fed into an integral tab die. There are typically thirteen to seventeen working stages involved in producing the can end tab.

At all stages of the can end production process, the ends are constantly scanned by cameras and sophisticated leak detection systems. Functional checks are performed by computer controlled equipment and are backed up by extensive visual checks. These tests are essential in confirming the integrity of the product before the ends are packed into paper sleeves and palletized for shipment.

The processes for producing the components of a two-piece beverage can, the can bodies, can ends, and can end tabs, all begin with a large coil of aluminum or steel sheet being fed from an uncoiler or payoff reel to a first two-piece beverage can component process. These coils may weigh between 8 to 15 tons or even more, and the receiving and handling costs associated with processing the coils is considerable. Because the coils are of a fixed, uniform width, scrap accumulation is significant, and can exceed 10% of the weight of the coil.

In addition, this scrap must be processed to transfer it from the plant. The scrap may be baled or compacted for transport. These processes are costly to run and maintain.

Moreover, the use of coils can slow down two-piece beverage can component manufacture as a new coil must be loaded onto the uncoiler or payoff reel when the old coil is spent.

Thus, there is a need for a method of forming two-piece beverage can components which reduces scrap accumulation and improves productivity.

The present invention is provided to solve the problems discussed above and other problems, and to provide advantages and aspects not provided by prior methods of this type.

A full discussion of the features and advantages of the present invention is deferred to the following detailed description, which proceeds with reference to the accompanying drawings.

SUMMARY OF THE INVENTION

The present invention is directed to a method of forming two-piece beverage can components. The method comprises the steps of providing a plurality of pre-punched metallic disks; providing a disk feeder for transferring at least one of the plurality of pre-punched metallic disks; providing a plurality of processing stations in operative alignment with the disk feeder; transferring a first disk from the plurality of pre-punched metallic disks via the disk feeder to a first station in the plurality of processing stations; performing a two-piece beverage can component manufacturing process on the first disk at the first station to form a deformed disk; removing the deformed disk from the first station; and transferring the deformed disk to each subsequent processing station in the plurality of processing stations, and performing a further two-piece beverage can component manufacturing process in each subsequent processing station to produce a substantially finished two-piece beverage can component.

In one embodiment, the two-piece beverage can component is a finished or substantially finished can body. The plurality of processing stations comprises a cupper station, a bodymaker station, a trimmer station, and a necking station. The cupper station receives the first disk from the disk feeder, and deforms the first disk to form a shallow cup. The bodymaker station includes tooling for drawing and thinning the shallow cup to form a thin-walled tubular can body having an open end and an opposing closed end. The trimmer station includes a knife for shearing excess material about the open end of the tubular can body. The necking station includes tooling for reducing the diameter of the open end of the tubular can body.

In one aspect of the embodiment, the plurality of processing stations further comprises a washer station, a decorative coating station, a decorative coating dryer station, an inner surface coating station, and a second dryer station. The washer station is located between the trimmer station and the necking station, and is provided to clean the inner and outer surfaces of the thin-walled tubular can body. The decorative coating station is located between the washer station and the necking station. The decorative coating station applies a decorative layer of coating to the outer surface of the thin-walled tubular can body. The decorative coating dryer station is located between the decorative coating station and the necking station. The inner surface coater is located between the decorative drying station and the necking station. The inner surface coater applies an inner surface layer of coating to the inner surface of the thin-walled tubular can body. The second drying station is located between the inner surface coater and the necking station.

In another aspect of the embodiment, the plurality of processing stations further comprises a base coater station and a base coat dryer station. The base coater station is located between the washer station and the decorative coating station, and applies a base layer of coating to the outer surface of the thin-walled tubular can body. The base coat dryer station is located between the base coater station and the decorative coating station.

In another aspect of the embodiment, the washer station includes a drying step.

In another aspect of the embodiment, the plurality of processing stations further comprises a plurality of bodymaker stations.

In another aspect of the invention, the plurality of processing stations further comprises a lubricator station located between the disk feeder and the cupper station.

In a second embodiment, the two-piece beverage can component is a finished or substantially finished can end or lid. The plurality of processing stations comprises a shell press station and a conversion press station. The shell press receives the first disk from the disk feeder, and deforms the first disk to form a can end shell. The conversion press receives the can end shell, and further deforms the can end shell to form a finished or substantially finished can end.

In one aspect of the second embodiment, the plurality of processing stations further comprises a lining station. The lining station is located between the shell press station and the conversion press station, and applies a sealant layer on a portion of the can end shell.

In another aspect of the second embodiment, the plurality of processing stations further comprises a first rollover station and a second rollover station. The first rollover station located between the shell press station and the lining station. The first rollover station reverses an orientation of the can end shell received from the shell press station. The second rollover station is located between the lining station and the conversion press station. The second rollover station reverses an orientation of the can end shell received from the lining station.

In another aspect of the second embodiment, the plurality of processing station further comprises a can end tab station. The can end tab station includes a source of metal sheet, and forms the metal sheet into a can end tab.

In another aspect of the second embodiment, the can end tab is staked to the can end shell during a process carried out at the conversion press station.

In a third embodiment, the two-piece beverage can component is a can end tab. The plurality of processing stations comprises a can end tab station and a conversion press station. The can end tab receives the first disk from the disk feeder, and deforms the first disk to form a can end tab. The conversion press station receives the can end tab, and stakes the can end tab to a can end shell.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
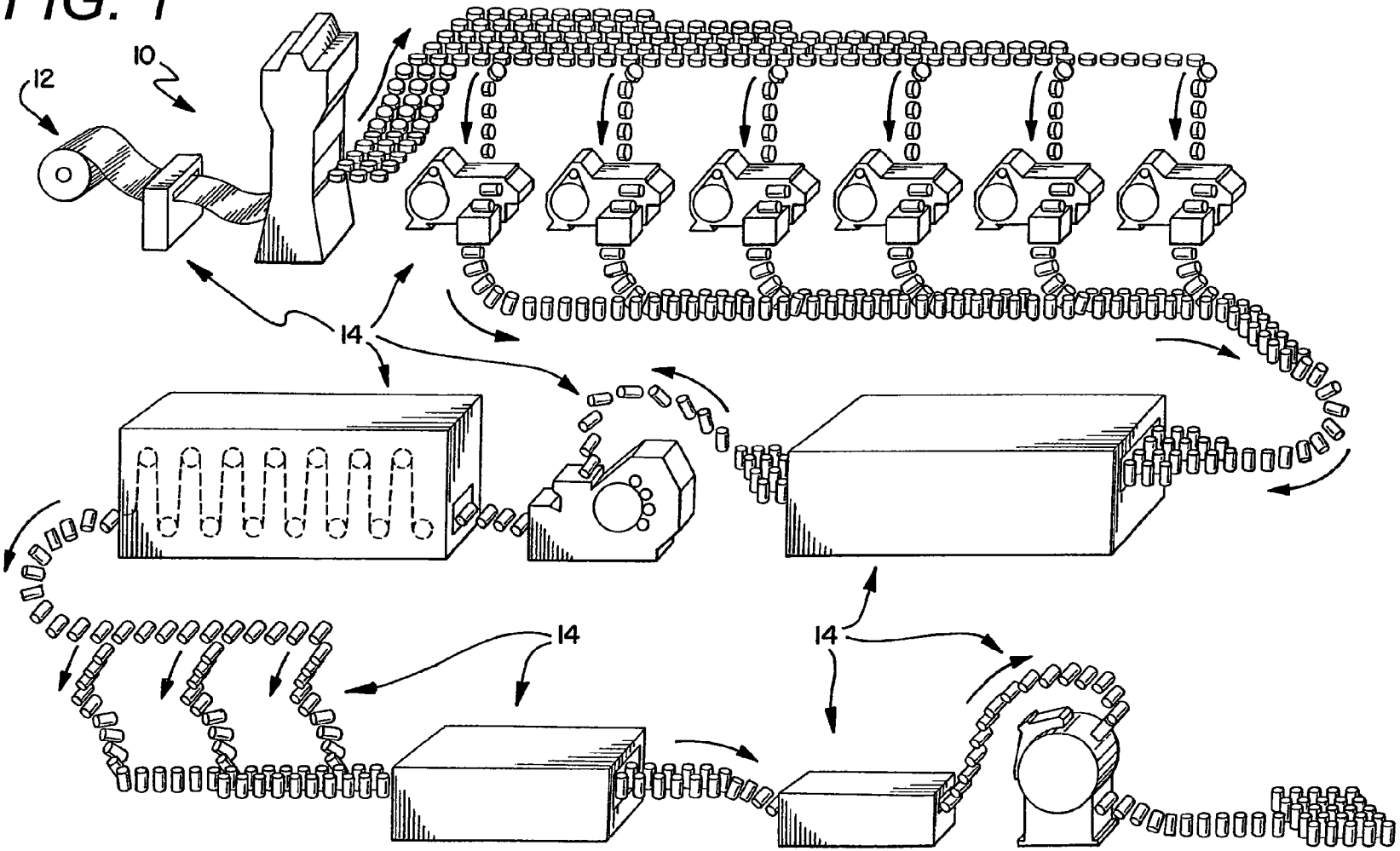
FIG. 1 is a schematic of a prior art can body manufacturing process.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
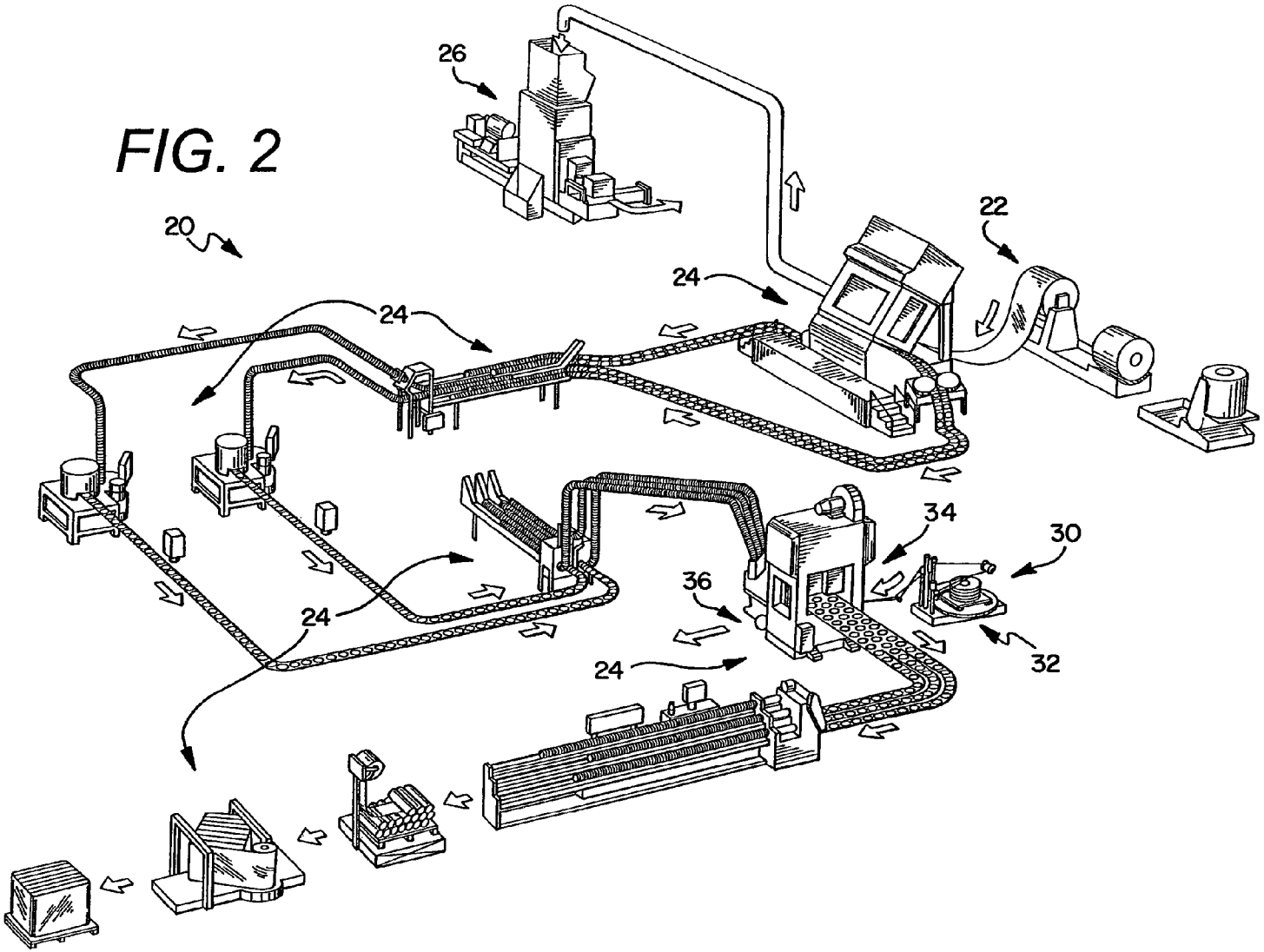
FIG. 2 is a schematic of a prior art can end manufacturing process.

FIGS. 1 and 2 illustrate typical two-piece beverage can component manufacturing processes 10, 20, 30. The processes include a coil delivery station 12, 22, 32 where a coil of flat metal sheet, e.g. aluminum or steel, is transferred to a plurality of two-piece beverage can component processing stations 14, 24, 34, including a recycle process stations 26, 36, each station in operative alignment to allow for a continuous manufacturing process. In the manufacturing process of FIG. 1, the flat metal sheet is converted into a finished or substantially finished two-piece beverage can component, e.g. a can body, a can end (lid), or a can end tab. In the manufacturing process of FIG. 2, the flat metal sheet is converted in to a finished or substantially finished can end.

Now referring to FIGS. 3-7, the two-piece beverage can component manufacturing method of the present invention does not include a coil delivery station. Rather, the method of the present invention replaces the metal coil delivery station with a disk feeder for transferring at least one of a plurality of pre-punched metallic disks to a plurality of two-piece beverage can component processing stations. Accordingly, the present invention is generally directed to a method for forming two-piece beverage can components comprising the steps of: providing a plurality of pre-punched metallic disks; providing a disk feeder for transferring at least one of the plurality of pre-punched metallic disks; providing a plurality of processing stations in operative alignment with the disk feeder; transferring a first disk from the plurality of pre-punched metallic disks via the disk feeder to a first station in the plurality of processing stations; performing a two-piece beverage can component manufacturing process on the first disk at the first station to form a deformed disk; removing the deformed disk from the first station; and transferring the deformed disk to each subsequent processing station in the plurality of processing stations, and performing a further two-piece beverage can component manufacturing process in each subsequent processing station to produce a substantially finished two-piece beverage can component.

Figure 3:
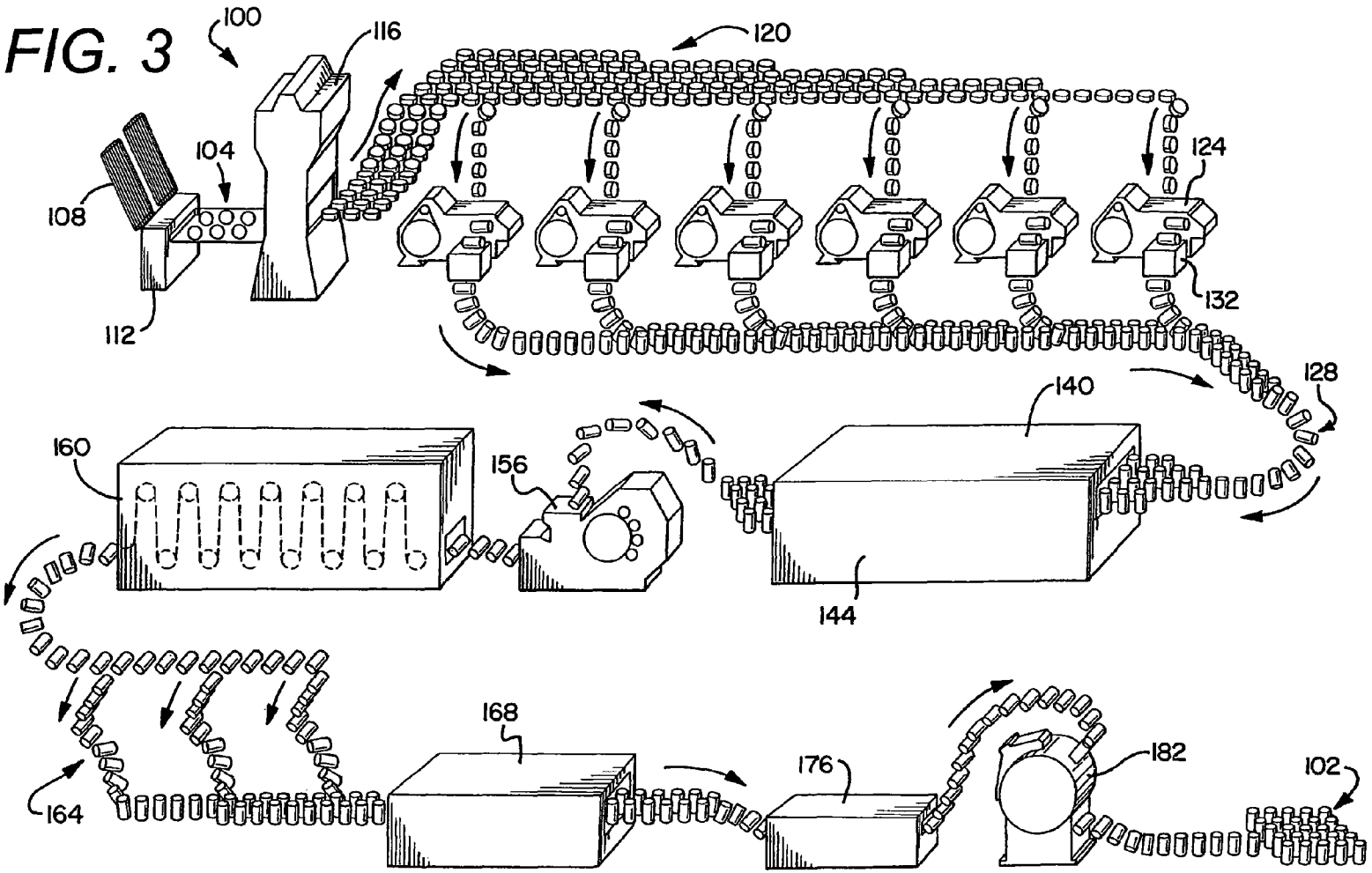
FIG. 3 is a schematic of a can body manufacturing process of the present invention.
Figure 4:
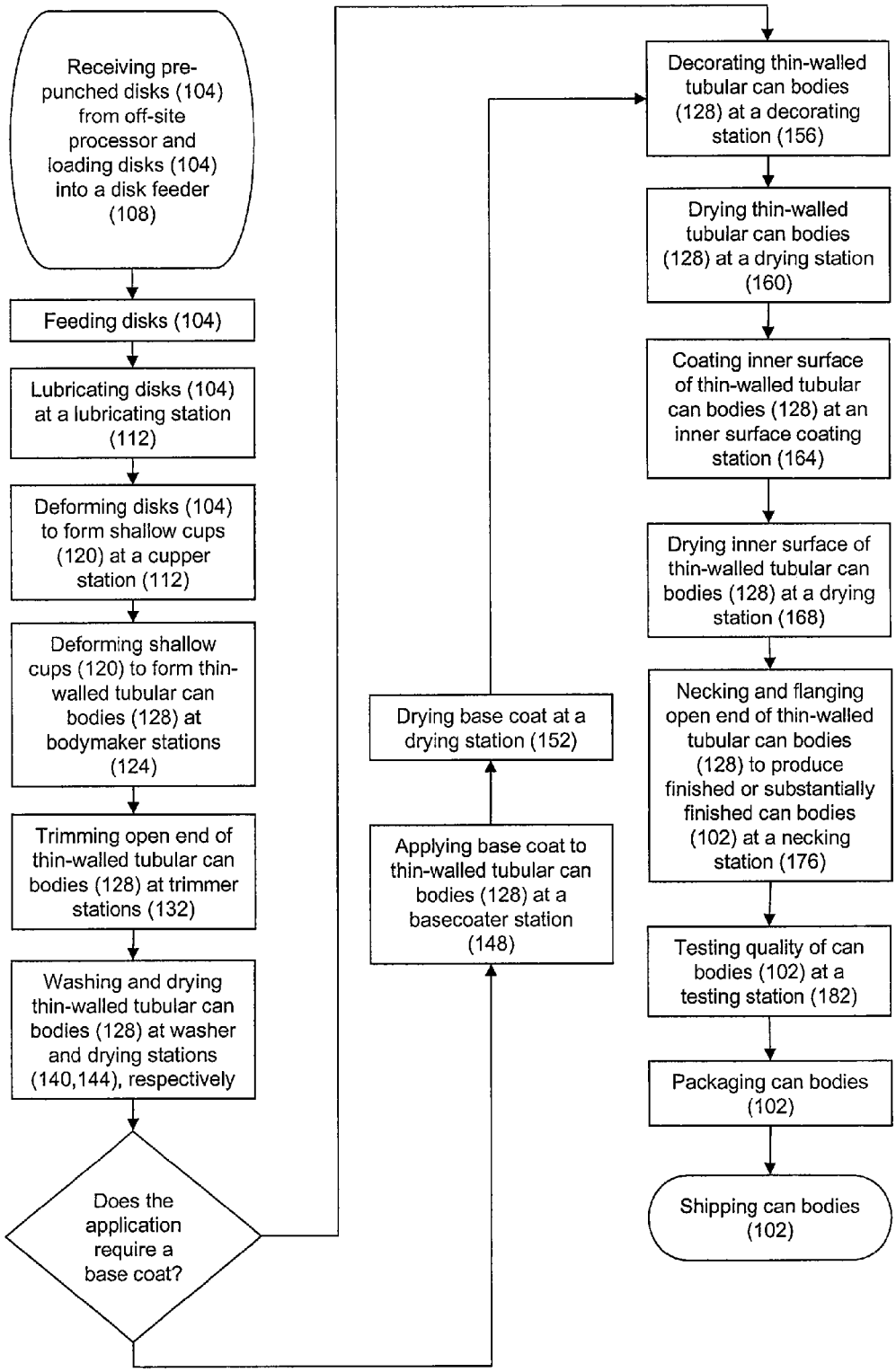
FIG. 4 is a flowchart of a can body manufacturing process of the present invention.

Referring to FIGS. 3-4, in one embodiment, a can body manufacturing apparatus 100 which carries out a method of the present invention is used to form a can body 102. A finished or substantially finished can body 102 includes a thin-walled, tubular sidewall having a closed end and an opposing open end. The sidewall carries indicia typically identifying the contents, brand, size etc. of the finished two-piece beverage can. The closed end is domed inwardly. The opposing end is necked radially inwardly to reduce the diameter of the open end. Such a structure is the standard in two-piece beverage cans manufactures all over the world, and is described in countless publications.

The method of this embodiment includes providing a plurality of a plurality of pre-punched metallic disks 104. The disks 104 are preferably punched at location other than the can body manufacturing site, and shipped to and received by the can body manufacturing plant. Accordingly, large numbers of pre-punched disks 104 can be received at the can body manufacturing site in any one of number of modes. Preferably, the disks 104 are arranged in a uniform orientation that promotes automation. For instance, the disks 104 can be delivered such that each disk 104 is directionally consistent, e.g. in rolling direction and/or grain direction, with the adjacent the disks. The disks 104 can be received in sleeves and in proper orientation so that transfer and loading is facilitated.

The delivered pre-punched disks may be further preformed at a location other than the can body manufacturing plant. It may be desirable for the pre-punched disks to be formed into a shallow cup, having bottom portion joined to a circumferential sidewall. The sidewall is preferably very short and may be tapered outwardly from the outer perimeter of the bottom portion wherein the opening of the shallow cup-shaped disk is slightly wider than the outer perimeter of the bottom portion. This variation would facilitate stacking, orientation, and further processing of the pre-punched disks at the can body manufacturing plant. As used herein the term "pre-punched disk," and/or simply "disk," unless otherwise modified, is intended to mean a disk which is can be either flat or of the shallow cup-shape as described above.

The method further includes providing a disk feeder 108 for transferring at least one of the plurality of pre-punched metallic disks. The disk feeder 108 is an automated delivery system which could rely on gravity, spring-force, vacuum, etc. to remove a disk 104 from the plurality of disks and transfer the disk 104 to a first can body forming process station.

The disks may be pre-lubricated or a lubricator station 112 may be located between the disk feeder 108 and the next process station in the manufacturing sequence. The lubricator 112 applies a thin coating of oil to facilitate metal forming during the forming of the can body.

A cupper station 116 is in operative alignment with the disk feeder 108, and receives lubricated disks 104 for processing. The cupper station 116 deforms the disk 104 in a drawing process to form a shallow cup 120. The cupper station may simultaneously receive and process multiple disks 108 for increased productivity. Once complete, the shallow cups 120 drop from the cupper station 116 onto a cup conveyor for transfer to the next station.

The shallow cups 120 may be pre-lubricated or another lubricator station 122 may be located between the cupper station 116 and the next process station in the manufacturing sequence. The lubricator 122 applies a thin coating of oil to facilitate metal forming during the forming of the can body.

The shallow cups 120 are transferred continuously to one or more bodymaker stations 124. Each bodymaker station 124 includes tooling for drawing and thinning the shallow cups 120 to form thin-walled tubular can bodies 128 having an open end and an opposing closed end. Each bodymaker station 124 contains a tool called a punch, which forms the shape of the can body 128 by forcing the cup 120 through a series of progressively smaller circular ironing rings. This action draws the metal up the sides of the punch, ironing it into a can body 128. As the cup 120 is forced through the rings, its diameter is reduced, its walls are thinned and its height is increased. At the end of the punch stroke, the bottom is formed into a dome shape that strengthens the bottom of the can body 128. During this process, referred to as wall ironing, the metal must be lubricated to reduce frictional heat.

The thin-walled, tubular can bodies 128 are transferred from the bodymakers 124 to trimmer stations 132. The trimmer station includes a knife for shearing excess material about the open ends of the tubular can bodies 128. This process adapts the can bodies 128 to a uniform, predetermined height.

The can bodies 128 are then continuously transferred to a washer station 136. The washer 136 removes the forming lubricants before the application of outside decoration (or label) and inside protective coating. The washed can bodies 140 are discharged through a dryer station 144 where the can bodies 128 are dried with forced hot air.

Depending on end user requirements, a base layer of coating can be applied to the outer surface of the can bodies 128 at a base coater station 148. The base coating layer is generally a white or clear base coat. A base coat dryer station 152 may be provided for curing the base coat layer.

The can bodies 128 are then continuously transferred to a decorative coating station 156. The decorative coating station 156 applies a decorative layer of coating (ink) to the outer surface of the thin-walled tubular can bodies 128. The inked can bodies 128 move to a rotating varnish application roll that applies a clear coating over the entire outer sidewall. The clear coating protects the ink from scratching and contains lubricants that facilitate can conveying.

The can bodies 128 are transferred from the decorator 156 onto a pin (so that only the inside surface is contacted) and is conveyed through a decorator coating, or "pin" oven/drier station 160 where the ink is dried with forced hot air.

Following application and curing of the exterior decorative layer, the can bodies 128 are conveyed to an inner surface coater station 164. This station 164 includes a bank of spray machines that spray the inner surfaces of the can bodies 128 with an epoxy-based organic protective coating. The inside coating is also cured by forced hot air at another dryer station 168. The coating prevents the beverage from contacting or reacting with the metal of the inner surface of the can body 128.

After the can bodies 128 leave the drier station 168, they pass through a lubricator station that applies a thin film of lubricant to the exterior of the top (open end) where a neck and a flange will be formed. A necker/flanger station 176 reduces the diameter of the open ends of the can bodies 128, and gives the cans the characteristic neck shape. Here the diameter of the top of the can is reduced or "necked-in." The top of the can is flanged outwards to enable the end to be seamed on after the cans are filled with a beverage. Following this step, a finished or substantially finished, as in suitable for use by a beverage manufacturer, can body 102 is produced.

All finished cans are evaluated for leakage at a light tester station 182. The can flange is clamped against a sealing surface and, as the machine rotates, the outside surface is exposed to a bank of extremely bright lights. A photocell inside the can detects any entering light, triggering a reject mechanism. Rejected cans are recycled. After testing, the finished cans are placed on pallets for shipment to the customer filling operations.

Figure 5:
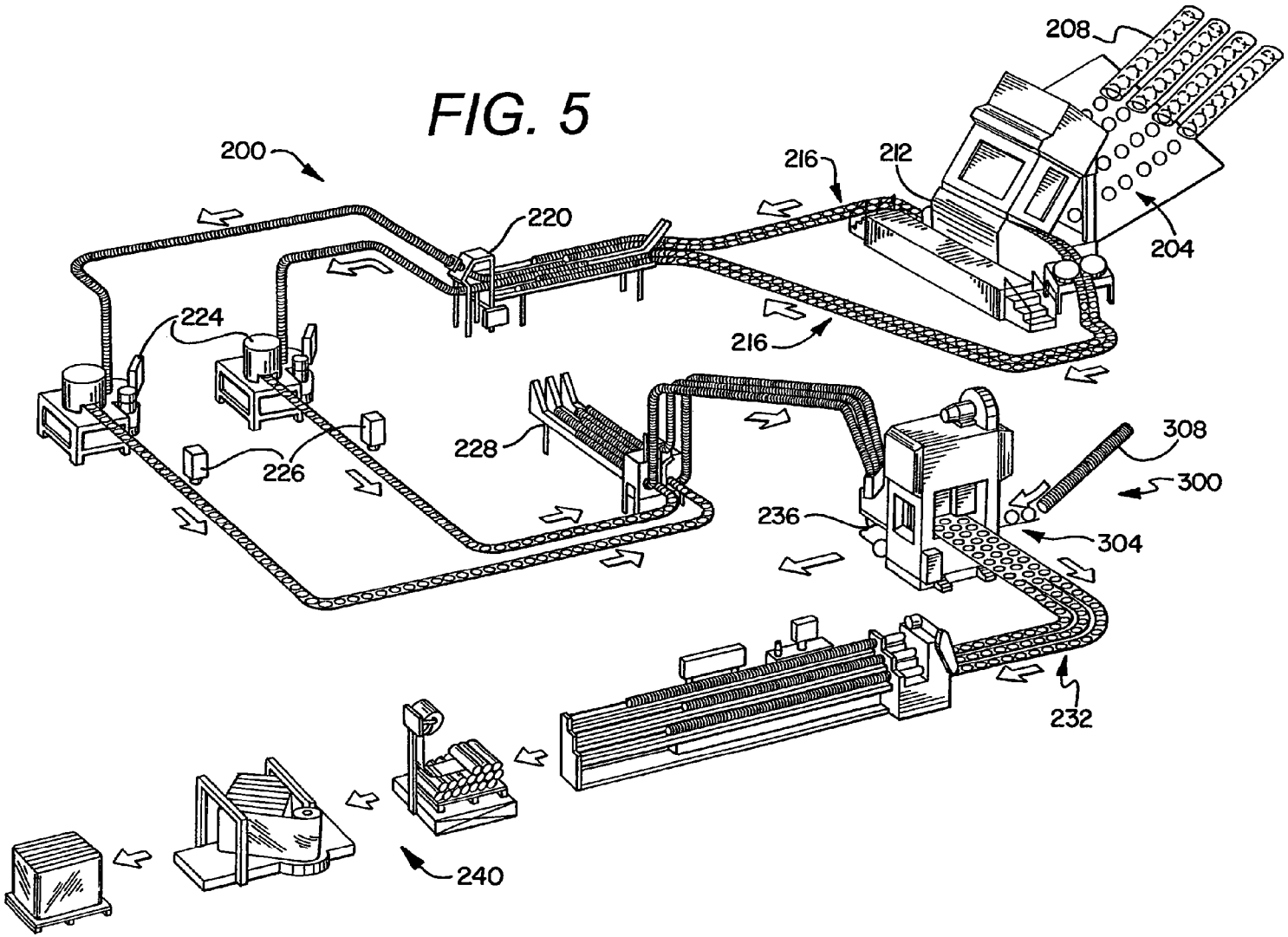
FIG. 5 is a schematic of a can end manufacturing process of the present invention.
Figure 6:
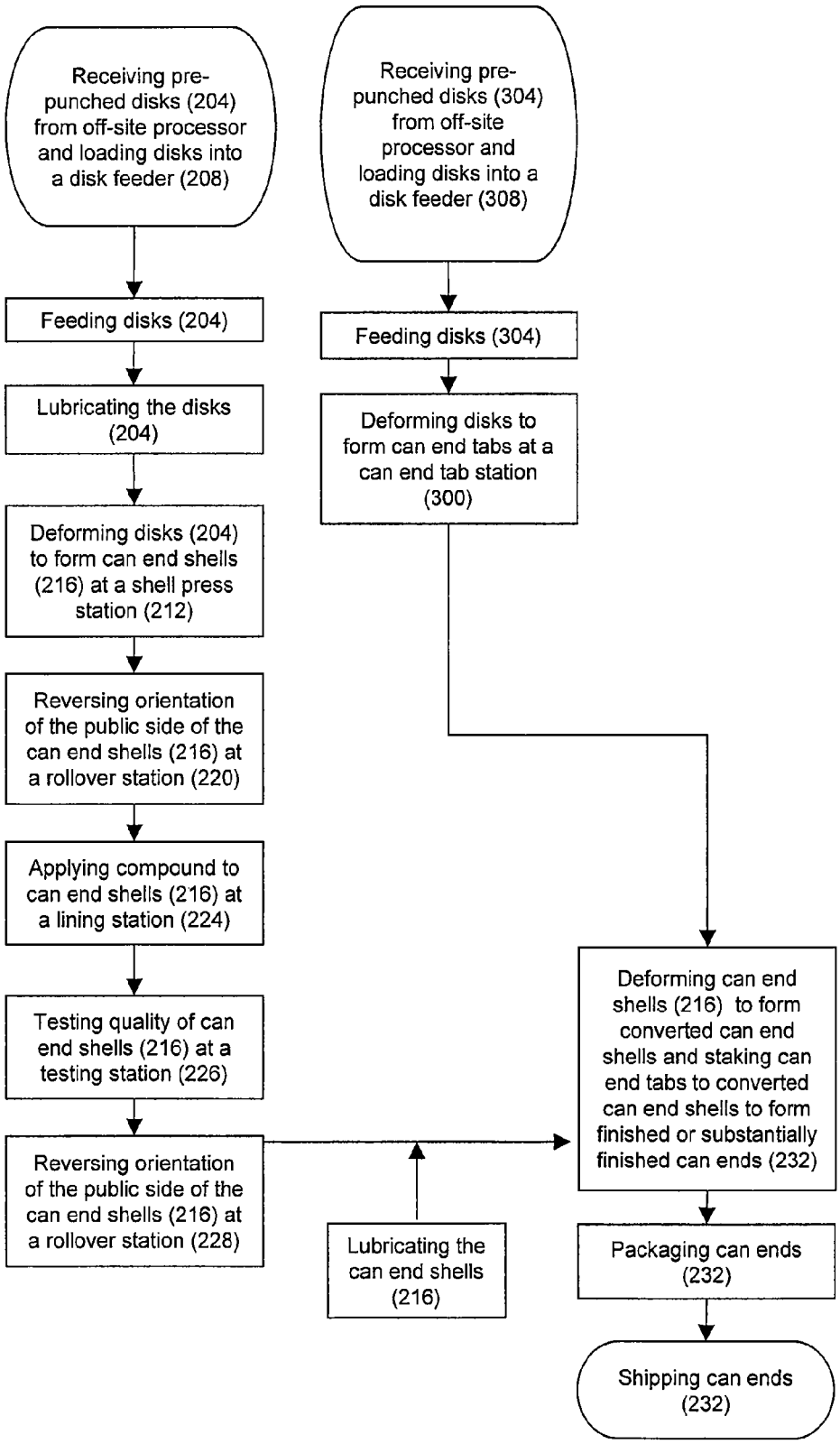
FIG. 6 is a flowchart of a can end manufacturing process of the present invention.

Now referring to FIGS. 5-6, a second embodiment of the present invention is illustrated. Here, a can end manufacturing apparatus 200 which carries out a method of the present invention is used to form a can end 202. A finished or substantially finished can end 202 includes a seaming curl joined to a center panel having a public side, product side, and a means for opening the center panel, typically either a thin film covering an aperture or a retainable tab overlying a frangible tear panel. Such a structure is the standard in two-piece beverage cans manufactures all over the world, and is described in countless publications.

The method of this embodiment includes providing a plurality of a plurality of pre-punched metallic disks 204. The disks 204 are preferably punched at location other than the can end manufacturing site, and shipped to and received by the can end manufacturing plant. Accordingly, large numbers of pre-punched disks 204 can be received at the can end manufacturing site in any one of number of modes. Preferably, the disks 204 are arranged in a uniform orientation that promotes automation. For instance, the disks 204 can be delivered such that each disk 204 is directionally consistent, e.g. in rolling direction and/or grain direction, with the adjacent the disks. The disks 204 can be received in sleeves and in proper orientation so that transfer and loading is facilitated. Can end disks 204 are preferably pre-coated on both the public and product sides with organic protective coatings containing lubricants. There are no plate lubrication, washing, coating or baking operations in the modern end manufacturing plant.

The method further includes providing a disk feeder 208 for transferring at least one of the plurality of pre-punched metallic disks. The disk feeder 208 is an automated delivery system which could rely on gravity, spring-force, vacuum, etc. to remove a disk 204 from the plurality of disks and transfer the disk 204 to a first can end forming process station.

The disks 204 may be pre-lubricated or another lubricator station may be located between the feeder 208 and the next process station in the manufacturing sequence. The lubricator applies a thin coating of oil to facilitate metal forming during the forming of the can end shell.

The first can end forming process station is a shell press 212. The shell press 212 is similar to the cupper in the can body manufacturing process. The shell press 212 deforms the disk 204 into a can end shell 216. The can end shell 216 is an end with no forming and no tab attached—just a flat disk with the outside diameter curled to accept a can neck. The forms the precise shape required for double seam formation (the operation that seals the can end to the flanged top of the can body after the can is filled).

The can end shells 216 are continuously transferred to a first rollover station 220 where the shell orientation is reversed. Here, the public side of each can end shell 216 is flipped to face downwardly.

The can end shells 216 are transferred to a lining station 224. At the lining station 224 a special type of sealant called compound is applied to the inside curl of each shell 216. This ensures a perfect curl when the finished end is seamed on to the can body. Inspection cameras may be located after the lining station 224 to inspect the shells 216.

The can end shells 216 are then continuously transferred to a second rollover station 228 where the shell orientation is reversed. Here, the product side of each can end shell 216 is flipped to face downwardly.

Prior to the final step, the can end shells 216 may be pre-lubricated or another lubricator station may be located between the lining station 224 and the next process station in the manufacturing sequence. The lubricator applies a thin coating of oil to facilitate metal forming during the forming of the converted can end.

The final part of the process is converting the lined shells 216 into finished or substantially finished can ends 232. This is done at a conversion press station 236. Here, the can end shells 216 are further deformed; the public side of the center panels are scored (or the apertures are formed); and a can end tab is staked to the public side of the center panel (or a peelable thin film cover is attached to the center panel to cover the aperture).

In the case where a tab is staked to the center panel of the can end, the method includes a can end tab station 300. The can end tab station 300 is located adjacent or is part of the conversion press 236. The can end tab station 300 requires a source of metal sheet, preferably a plurality of can end tab disks 244 with a can end tab disk feeder 248 to transfer the disks 304 to the can end tab station 300. Again, the disks 304 are preferably punched at location other than the can end tab manufacturing site, and shipped to and received by the can end tab manufacturing plant. Accordingly, large numbers of pre-punched disks 304 can be received at the can end tab manufacturing site in any one of number of modes. The can end tab station 300 deforms the disks 304 to form tabs which are staked to the public side of the center panel of the can end at the conversion press station 236.

The finished or substantially finished can ends 232 are packaged at a packaging station 240 for shipment to an enduser.

Figure 7:
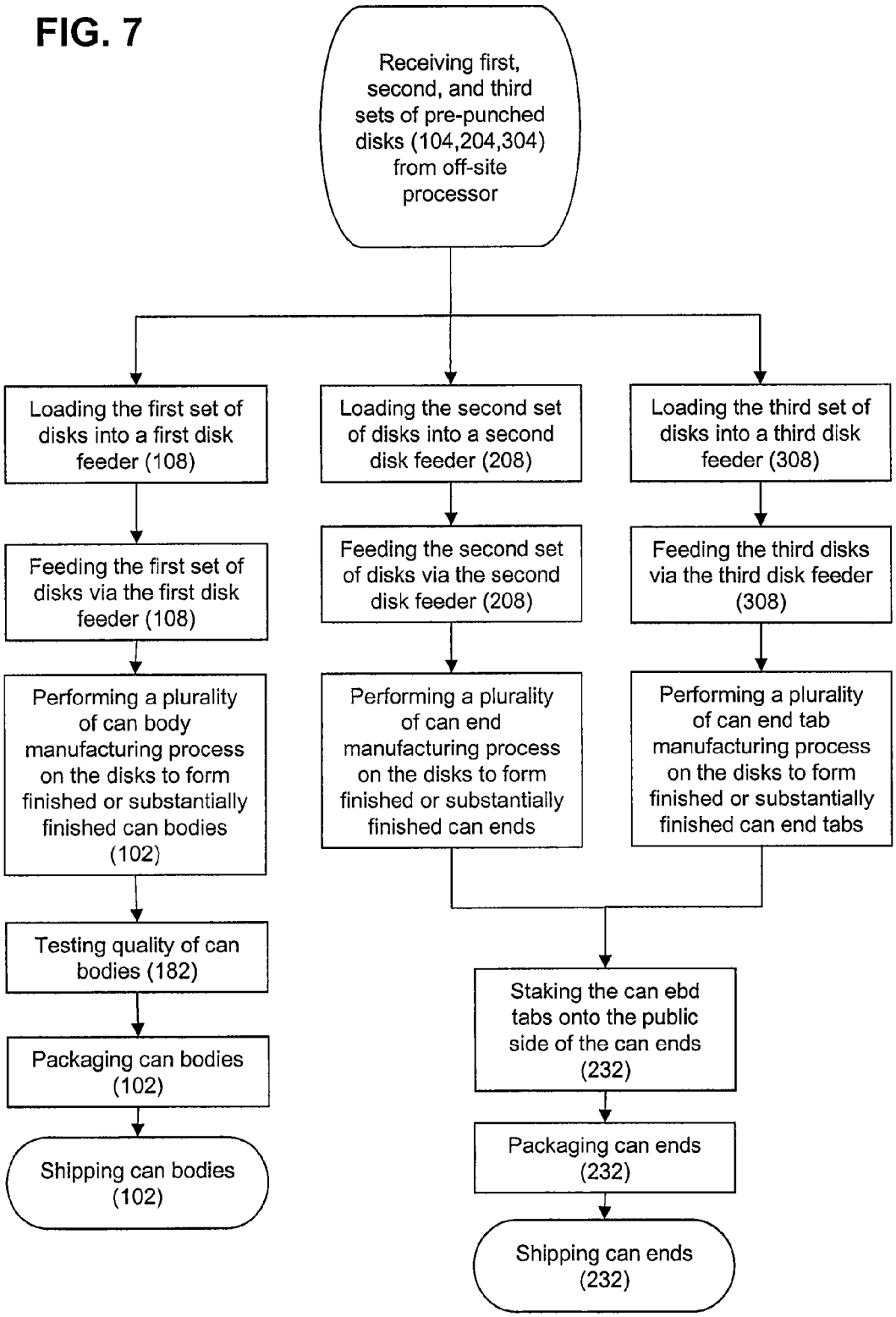
FIG. 7 is a flowchart of a method of manufacturing can bodies, can ends, and can end tabs.

Referring to FIG. 7, a flowchart for manufacturing two-piece beverage can components is illustrated. In this embodiment, the can bodies, can ends, and the can end tabs can be produced in one manufacturing location. Here, three different sizes of disks are delivered to the manufacturing site and converted can bodies, can ends, and can end tabs.

While the specific embodiments have been illustrated and described, numerous modifications come to mind without significantly departing from the spirit of the invention, and the scope of protection is only limited by the scope of the accompanying Claims.

What is claimed is:

1. A method of forming two-piece beverage can components, the method comprising the steps of:

providing a plurality of pre-punched metallic disks in a uniform orientation to promote automation as a first step in a process for manufacturing two-piece beverage can components;

providing a disk feeder for transferring at least one of said plurality of pre-punched metallic disks;

providing a plurality of processing stations in operative alignment with said disk feeder;

transferring a first disk from said plurality of pre-punched metallic disks via said disk feeder to a first station in the plurality of processing stations;

performing a two-piece beverage can component manufacturing process on said first disk at said first station to form a deformed disk;

removing said deformed disk from said first station; and transferring said deformed disk to each subsequent processing station in said plurality of processing stations, and performing a further two-piece beverage can component manufacturing process in each subsequent processing station to produce a substantially finished two-piece beverage can component.

2. The method of claim 1 wherein said plurality of processing stations comprises:

a cupper station, said cupper station receiving said first disk from said disk feeder, and deforming said first disk to form a shallow cup;

a bodymaker station, said bodymaker station including tooling for drawing and thinning said shallow cup to form a thin-walled tubular can body having an open end and an opposing closed end;

a trimmer station, said trimmer station including a knife for shearing excess material about said open end of said tubular can body; and a necking station, said necking station including tooling for reducing the diameter of said open end of said tubular can body.

3. The method of claim 2 wherein said plurality of processing stations further comprises:

a washer station located between said trimmer station and said necking station, said washer station cleaning inner and outer surfaces of said thin-walled tubular can body;

a decorative coating station located between said washer station and said necking station, said decorative coating station applying a decorative layer of coating to said outer surface of said thin-walled tubular can body;

a decorative coating dryer station located between said decorative coating station and necking station;

an inner surface coater station located between said decorative drying station and said necking station, said inner surface coater station applying a inner surface layer of coating to said inner surface of said thin-walled tubular can body; and a second drying station located between said inner surface coater and said necking station.

4. The method of claim 3 wherein said plurality of processing stations further comprises:

a base coater station located between said washer station and said decorative coating station, said a base layer of coating applied to said outer surface of said thin-walled tubular can body at said base coater station; and a base coat dryer station located between said base coater station and said decorative coating station.

5. The method of claim 3 wherein said washer station includes a drying step.

6. The method of claim 2 wherein said plurality of processing stations further comprises:

a plurality of bodymaker stations.

7. The method of claim 2 wherein said plurality of processing stations further comprises:

a lubricator station located between said disk feeder and said cupper station.

8. The method of claim 1 wherein said plurality of processing stations comprises:

a shell press station, said shell press receiving said first disk from said disk feeder, and deforming said first disk to form a can end shell; and a conversion press station, said conversion press receiving said can end shell, and further deforming said can end shell to form a finished can end.

9. The method of claim 8 wherein said plurality of processing stations further comprises:

a lining station, said lining station located between said shell press station and said conversion press station, said lining station applying a sealant layer on a portion of said can end shell.

10. The method of claim 9 wherein said plurality of processing stations further comprises:

a first rollover station located between said shell press station and said lining station, said first rollover station reversing an orientation of said can end shell received from said shell press station; and a second rollover station located between said lining station and said conversion press station, said second rollover station reversing an orientation of said can end shell received from said lining station.

11. The method of claim 8 wherein said plurality of processing station further comprises:

a can end tab station, said can end tab station including a source of metal sheet, and forming said metal sheet into a can end tab.

12. The method of claim 11 wherein said can end tab is staked to said can end shell during a process carried out at said conversion press station.

13. The method of claim 1 wherein said plurality of processing stations comprises:

a can end tab station, said can end tab receiving said first disk from said disk feeder, and deforming said first disk to form a can end tab; and a conversion press station, said conversion press receiving said can end tab, and staking said can end tab to a can end shell.

14. The method of claim 1 wherein at least one of said plurality of pre-punched of disks has a shallow cup shape.

15. A method of manufacturing two-piece beverage can components, the method comprising the steps of:

providing a first set of a plurality of pre-punched metallic disks in a uniform orientation to promote automation as a first step in a two-piece beverage can component manufacturing method;

providing a first disk feeder for transferring at least one of said first set of the plurality of pre-punched metallic disks;

providing a plurality of can body processing stations in operative alignment with said first disk feeder;

transferring a can body disk from said first set of the plurality of pre-punched metallic disks via said first disk feeder to a first can body forming station in the plurality of can body processing stations;

performing a can body manufacturing process on said first can body disk at said first can body forming station to form a cup;

removing said cup from said first can body forming station;

transferring said cup to each subsequent can body processing station in said plurality of can body processing stations, and performing a further can body manufacturing process in each subsequent can body processing station to produce a substantially finished can body;

providing a second set of a plurality of pre-punched metallic disks;

providing a second disk feeder for transferring at least one of said second set of the plurality of pre-punched metallic disks;

providing a plurality of can end processing stations in operative alignment with said second disk feeder;

transferring a can end disk from said second set of the plurality of pre-punched metallic disks via said second disk feeder to a first can end forming station in the plurality of can end processing stations;

performing a can end manufacturing process on said can end disk at said first can end forming station to form a can end shell;

removing said can end shell from said first can end forming station; and transferring said can end shell to each subsequent can end processing station in said plurality of can end processing stations, and performing a further can end manufacturing process in each subsequent can end processing station to produce a substantially finished can end.

16. The method of claim 15 further comprising the steps of:

providing a third set of a plurality of pre-punched metallic disks;

providing a third disk feeder for transferring at least one of said third set of the plurality of pre-punched metallic disks;

providing a can end tab processing station in operative alignment with said third disk feeder;

transferring a can end tab disk from said third set of the plurality of pre-punched metallic disks via said third disk feeder to said can end tab forming station;

performing a can end tab manufacturing process on said first can end tab at said can end tab forming station to form a can end tab;

removing said can end tab from said can end tab forming station;

transferring said can end tab to one of said plurality of can end processing stations; and staking said can end tab to said substantially finished can end at said one of said can end processing stations.

17. An improvement in a two-piece can component manufacturing method comprising the steps of providing a plurality of processing stations in operative alignment; performing a two-piece beverage can component manufacturing process on a metallic disk at one of the plurality of processing stations to form a deformed disk; removing the deformed disk from the one of the plurality of processing stations; and transferring the deformed disk to each subsequent processing station in the plurality of processing stations, and performing a further two-piece beverage can component manufacturing process in each subsequent processing station to produce a substantially finished two-piece beverage can component; the improvement comprising:

providing a plurality of pre-punched metallic disks in a uniform orientation to promote automation as a first step in the two-piece can component manufacturing method;

providing a disk feeder in operative alignment with a first processing station;

loading the pre-punched metallic disks onto the disk feeder; and feeding each of the plurality of pre-punched metallic disks into the first processing station.

18. The improvement of claim 17 further comprising:

replacing a coil delivery station with the disk feeder.

19. The improvement of claim 17 further comprising:

receiving the plurality of pre-punched disk from an outside source prior to said loading step.

20. The improvement of claim 17 wherein each of the plurality of pre-punched discs includes a shallow cup shape prior to the loading step.

* * * * *